US011111703B2

(12) United States Patent
Lim et al.

(10) Patent No.: US 11,111,703 B2
(45) Date of Patent: Sep. 7, 2021

(54) HOOD LATCH APPARATUS FOR VEHICLE

(71) Applicants: HYUNDAI MOTOR COMPANY, Seoul (KR); KIA MOTORS CORPORATION, Seoul (KR); PYEONG HWA AUTOMOTIVE CO., LTD., Daegu (KR)

(72) Inventors: Sang Kyoon Lim, Bucheon-Si (KR); Sang Il Kim, Hwaseong-Si (KR); Dong Hee Ma, Hwaseong-Si (KR); Jin Pyung Park, Goyang-Si (KR); Seong-Tae Hong, Suwon-Si (KR)

(73) Assignees: Hyundai Motor Company, Seoul (KR); Kia Motors Corporation, Seoul (KR); Pyeong Hwa Automotive Co., Ltd., Daegu (KR)

( * ) Notice: Subject to any disclaimer, the term of this patent is extended or adjusted under 35 U.S.C. 154(b) by 504 days.

(21) Appl. No.: 16/178,016

(22) Filed: Nov. 1, 2018

(65) Prior Publication Data

US 2019/0277069 A1 Sep. 12, 2019

(30) Foreign Application Priority Data

Mar. 12, 2018 (KR) ..... 10-2018-0028633

(51) Int. Cl.
*E05B 83/24* (2014.01)
*E05B 77/34* (2014.01)
(Continued)

(52) U.S. Cl.
CPC ..... *E05B 83/24* (2013.01); *E05B 77/34* (2013.01); *E05B 77/40* (2013.01); *E05B 85/02* (2013.01); *E05Y 2900/536* (2013.01)

(58) Field of Classification Search
CPC ..... E05B 77/34; E05B 77/40; E05B 83/24; E05B 85/02; E05Y 2900/536
See application file for complete search history.

(56) References Cited

U.S. PATENT DOCUMENTS 6,422,616 B1 * 7/2002 Wortmann ..... E05B 83/24 292/214
2012/0049543 A1 3/2012 Park
(Continued)

FOREIGN PATENT DOCUMENTS

JP 2019108710 A * 7/2019
KR 20100025114 A * 3/2010
(Continued)

*Primary Examiner* — Kristina R Fulton
*Assistant Examiner* — James Edward Ignaczewski
(74) *Attorney, Agent, or Firm* — Morgan, Lewis & Bockius LLP

(57) ABSTRACT

A hood latch apparatus for a vehicle includes: a housing having entrance guide recesses at a front portion and a rear portion, respectively, to allow a striker to enter; a first support shaft and a second support shaft disposed at both sides of the entrance guide recesses, respectively; a claw rotatably connected to the first support shaft; a pawl rotatably connected to the second support shaft and configured to restrain the claw or release the restraint of the claw; a safety hook rotatably connected to the second support shaft and configured to restrict the opening of a hood; and a safety lever having one end of thereof rotatably supported on a third support shaft installed inside the housing, and including a user manipulation portion extending to an outside of the housing and a pressing portion for pressing a lower portion of the safety hook.

6 Claims, 9 Drawing Sheets

(51) Int. Cl.
*E05B 85/02* (2014.01)
*E05B 77/40* (2014.01)

(56) References Cited

U.S. PATENT DOCUMENTS

2015/0115625 A1* 4/2015 Park ..... E05B 83/24
292/194
2020/0071971 A1* 3/2020 Cho ..... B62D 25/12

FOREIGN PATENT DOCUMENTS

KR 20170007973 A * 1/2017
KR 20180070396 A * 6/2018

* cited by examiner

HOOD LATCH APPARATUS FOR VEHICLE

CROSS-REFERENCE TO RELATED APPLICATION(S)

This application is based on and claims priority under 35 U.S.C. § 119 to Korean Patent Application No. 10-2018-0028633, filed on Mar. 12, 2018 in the Korean Intellectual Property Office, the disclosure of which is incorporated by reference herein in its entirety.

TECHNICAL FIELD

The present disclosure relates to a hood latch apparatus for a vehicle capable of restraining a hood of the vehicle or releasing restraint of the hood.

BACKGROUND

A vehicle has a hood for opening or closing an upper portion of an engine compartment. A rear side of the hood is pivotally connected to a vehicle body and a front side thereof is engaged with a hood latch apparatus mounted on the vehicle body. The hood latch apparatus may restrain the hood by locking a striker mounted on a lower surface of the hood and release the restraint of the hood by unlocking the striker in order to open the hood.

A typical hood latch apparatus may include a claw for practically locking a striker, a pawl for restraining the claw or releasing the restraint of the claw, a safety hook for restricting opening of a hood by hooking the striker, which is lifted after being released from the restraint of the claw, when opening the hood, and a safety lever connected to the safety hook so that a user rotates the safety hook to finally release the restraint of the hood.

The opening operation of the hood by the hood latch apparatus is performed by a first step in which the striker is caught in the safety hook as the hood is lifted after the locking of the striker by the claw is released according to a user's manipulation for opening the hood, wherein the user is in the driver's seat of a vehicle, and a second step in which the restraint of the striker by the safety hook is released by the direct manipulation of the safety lever of the user after the opening of the hood according to the first step.

However, such a hood latch apparatus is not only bulky, but also has a complicated appearance on the front face because the safety hook and the safety lever are installed in an exposed state on the front surface of a housing of the hood latch apparatus, and shafts that rotatably support the safety hook and the safety lever and a spring that is provided on the shaft to rotate the safety lever are exposed in a state protruding from the front surface of the housing.

Further, such a hood latch apparatus also has drawbacks in that the durability is degraded due to corrosion and the like because the safety hook, spring and shafts are exposed outside the housing.

SUMMARY

It is an aspect of the present disclosure to provide a hood latch apparatus for a vehicle capable of providing a beautiful front appearance, reducing the volume, and enhancing the durability, by minimizing the exposure of components.

Additional aspects of the present disclosure will be set forth in part in the description which follows and, in part, will be obvious from the description, or may be learned by practice of the disclosure.

In accordance with one aspect of the present disclosure, a hood latch apparatus for a vehicle includes: a housing having entrance guide recesses formed at a front portion and a rear portion, respectively, to allow a striker to enter; a first support shaft and a second support shaft disposed at both sides of the entrance guide recesses of the housing, respectively, while both ends of each of the first support shaft and the second support shaft are supported at the front portion and the rear portion of the housing; a claw rotatably connected to the first support shaft in the housing and configured to catch and restrain the striker entering an inside of the housing or release the restraint of the striker; a pawl rotatably connected to the second support shaft in the housing and configured to restrain the claw or release the restraint of the claw; a safety hook rotatably connected to the second support shaft in the housing and configured to restrict the opening of a hood by catching the striker that is lifted after the restraint by the claw is released; and a safety lever having one end thereof rotatably supported on a third support shaft disposed inside the housing, the safety lever including a user manipulation portion extending to an outside of the housing and a pressing portion for pressing a lower portion of the safety hook to rotate the safety hook in a restraint releasing direction during a rotation operation.

The third support shaft may be installed on a lower side at an intermediate portion between the first support shaft and the second support shaft, the safety lever may include a lateral extension portion extending in a lateral direction of the housing from the third support shaft in the housing, and the pressing portion may be provided at an upper side of the lateral extension portion so as to press and rotate a lower end of the safety hook.

The user manipulation portion of the safety lever may extend from the lateral extension portion to the outside of the housing laterally by passing through the front portion of the housing.

The safety hook may include a protective cover portion covering both sides of a portion coupled to the second support shaft and a portion in contact with the pressing portion.

The protective cover portion may be coupled to the safety hook in an integrated manner by injection molding of a resin material.

The hood latch apparatus may further include a support plate installed inside the housing to divide the inside of the housing into a space in which the claw and the pawl are installed and a space in which the safety hook and the safety lever are installed, and configured to support the first support shaft, the second support shaft, and the third support shaft.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Hereinafter, embodiments of the present disclosure will be described in detail with reference to the accompanying drawings. The following embodiments are provided to fully convey the spirit of the present disclosure to a person having ordinary skill in the art to which the present disclosure belongs. The present disclosure is not limited to the embodiments shown herein but may be embodied in other forms. The drawings are not intended to limit the scope of the present disclosure in any way, and the size of components may be exaggerated for clarity of illustration.

Figure 1:
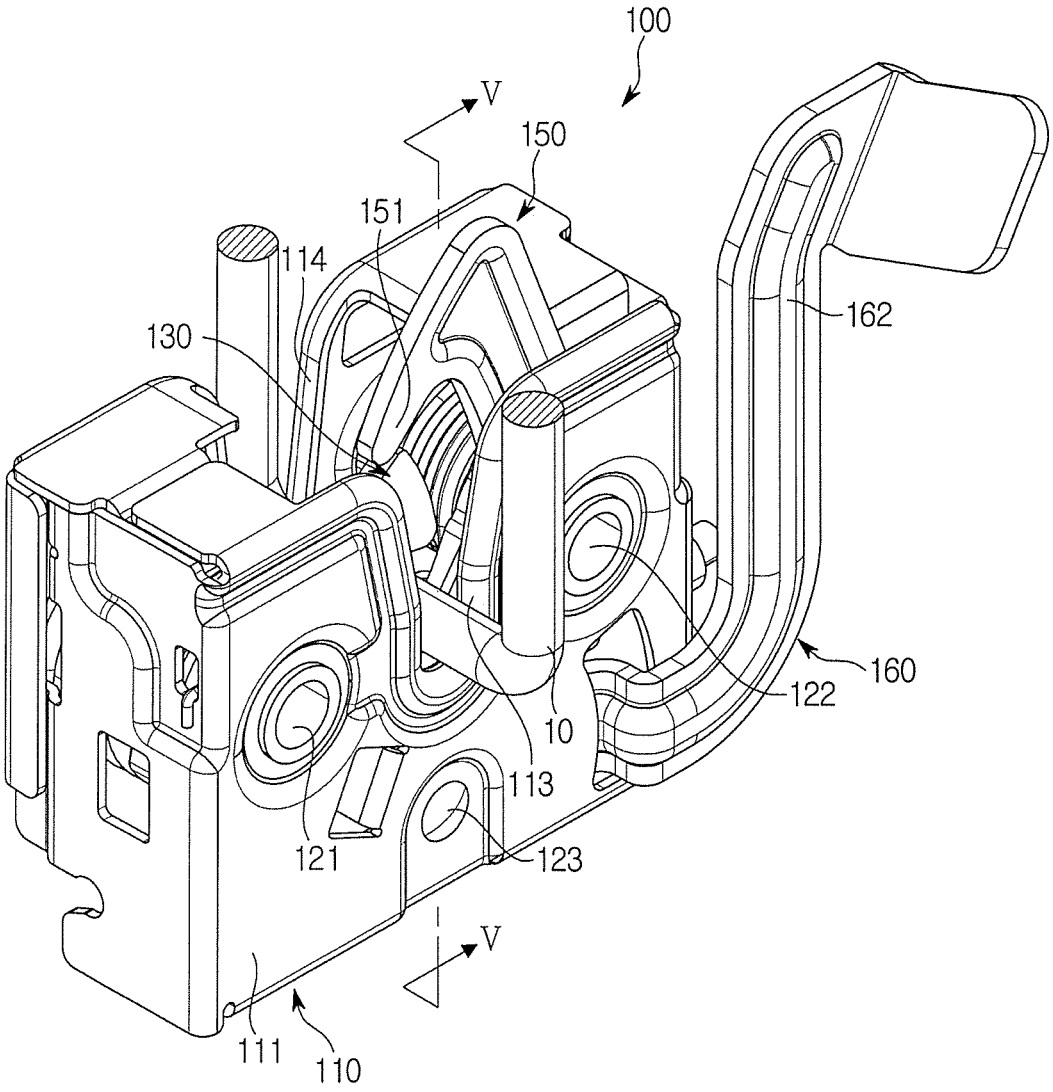
FIG. 1 is a perspective view illustrating a front portion of a hood latch apparatus for a vehicle according to an embodiment of the present disclosure.
Figure 2:
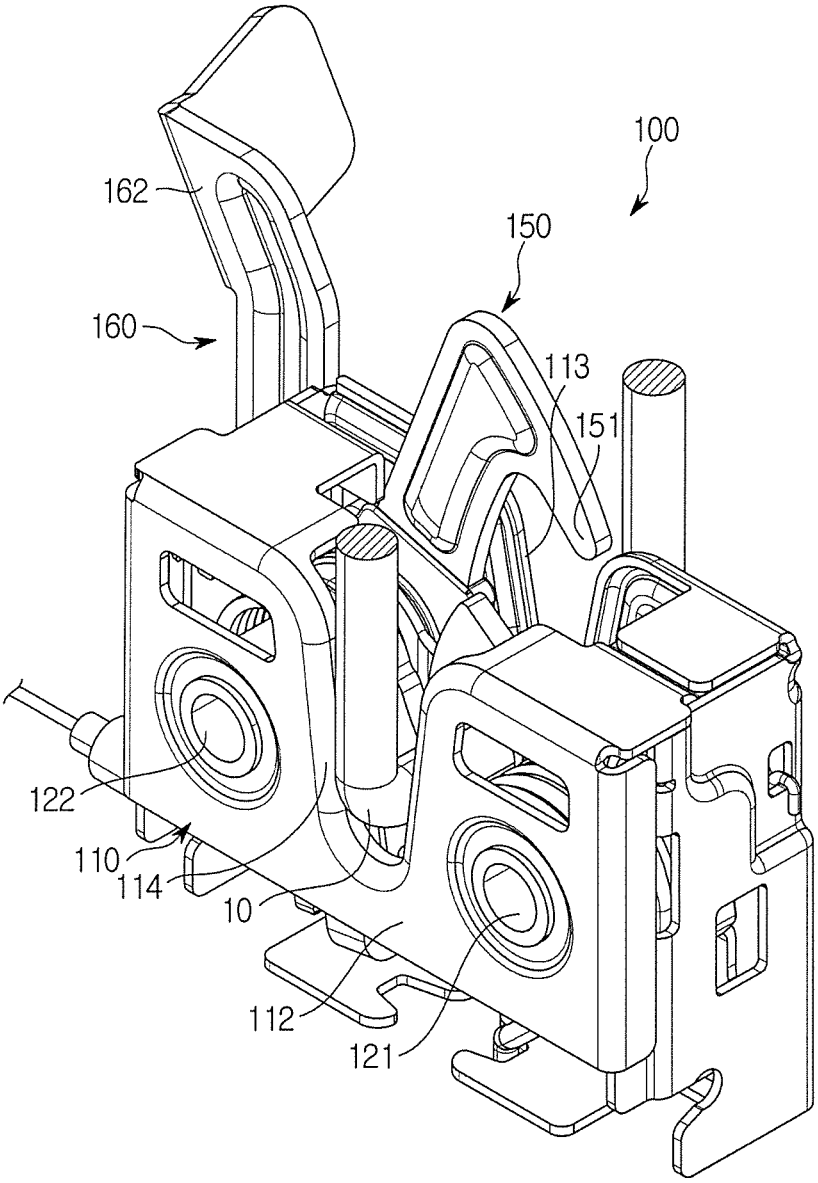
FIG. 2 is a perspective view illustrating a rear portion of a hood latch apparatus for a vehicle according to an embodiment of the present disclosure.
Figure 3:
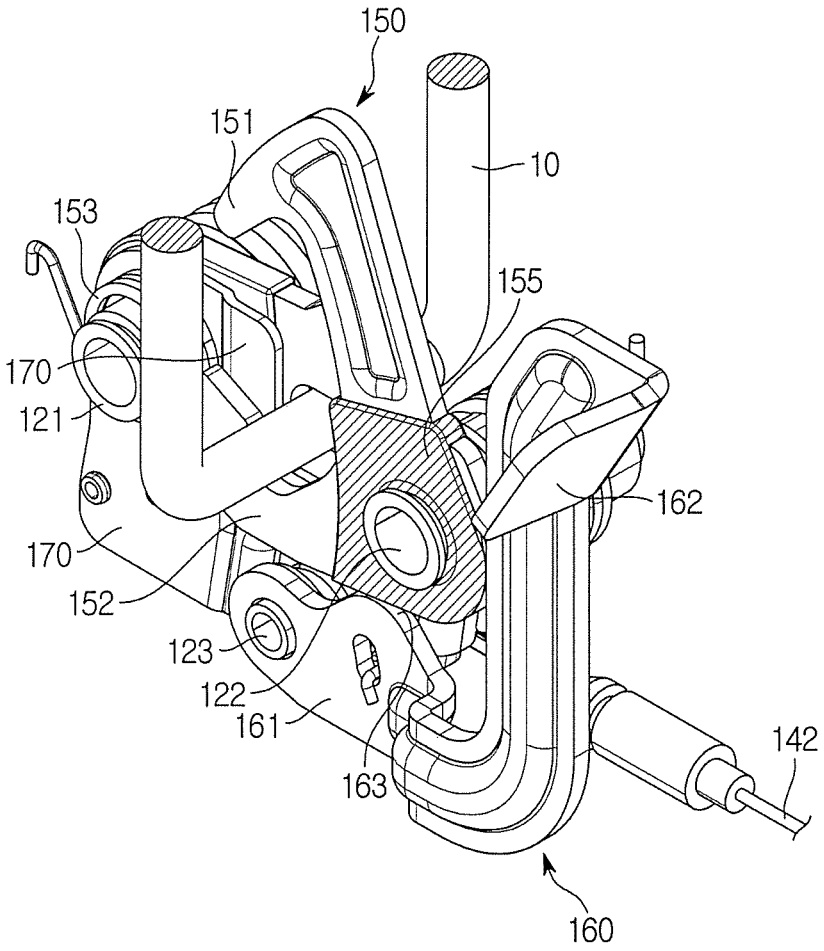
FIG. 3 is a perspective view illustrating a front portion of internal components in a state where a housing of a hood latch apparatus for a vehicle according to an embodiment of the present disclosure is removed.
Figure 4:
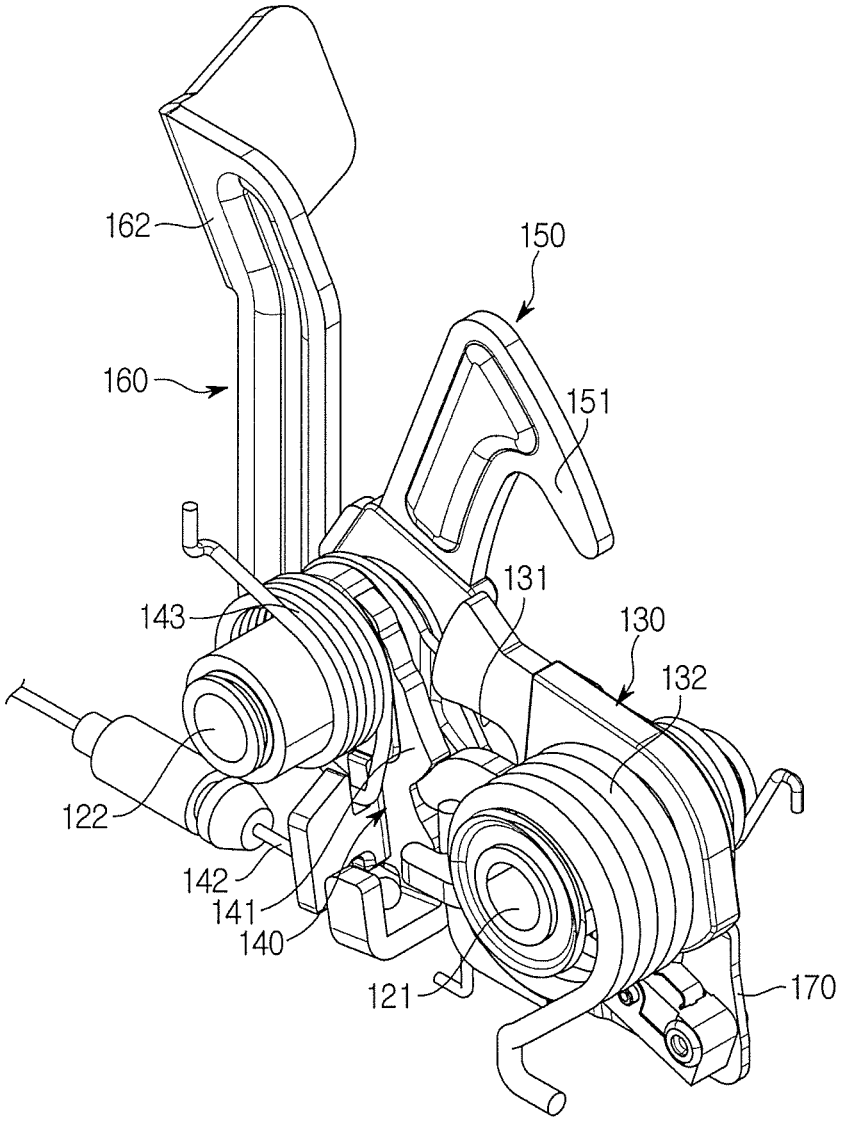
FIG. 4 is a perspective view illustrating a rear portion of the internal components in a state where the housing of a hood latch apparatus for a vehicle according to an embodiment of the present disclosure is removed.
Figure 5:
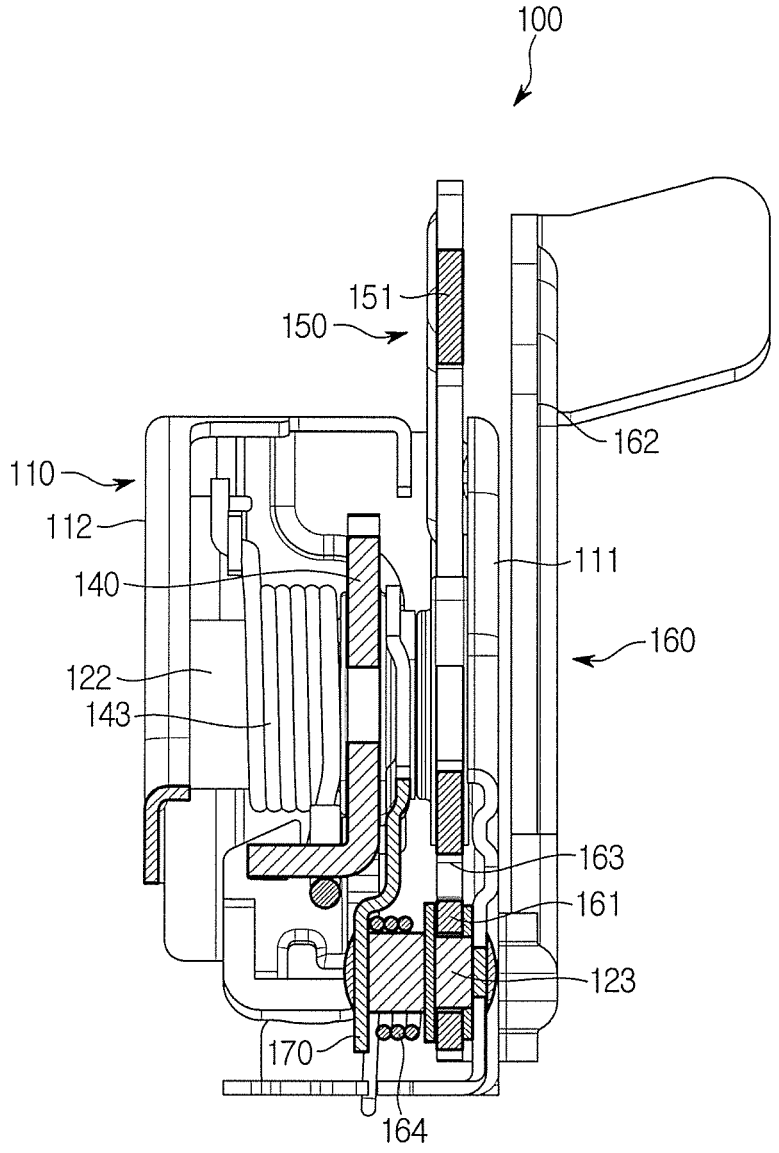
FIG. 5 is a cross-sectional view taken along line V-V' in FIG. 1.

FIG. 1 is a perspective view illustrating a front portion of a hood latch apparatus for a vehicle according to an embodiment of the present disclosure, and FIG. 2 is a perspective view illustrating a rear portion of the hood latch apparatus for a vehicle. FIG. 3 is a perspective view illustrating a front portion of internal components in a state where a housing of the hood latch apparatus for a vehicle is removed, and FIG. 4 is a perspective view illustrating a rear portion of the internal components in a state where the housing is removed. Further, FIG. 5 is a cross-sectional view taken along line V-V' in FIG. 1.

Referring to FIGS. 1 to 5, a hood latch apparatus 100 may be installed on a vehicle body of a front portion of an engine compartment of a vehicle to lock or unlock a striker 10 which is mounted on a hood (not shown). The hood latch apparatus 100 may include a housing 110, a first support shaft 121, a second support shaft 122, a third support shaft 123, a claw 130, a pawl 140, a safety hook 150, and a safety lever 160.

The housing 110 may be provided in the form of a rectangular box. The housing 110 may be fixed to the vehicle body such that a front portion 111 faces the front of the vehicle and a rear portion 112 faces the rear of the vehicle. An upper portion of the housing 110 is partially opened so that the striker 10 coupled to the hood of the vehicle can enter the housing 110 and an upper side of the safety hook 150 can be exposed. The front portion 111 and the rear portion 112 of the housing 100 are formed with entrance guide recesses 113 and 114 to allow the striker 10 to enter. The entrance guide recesses 113 and 114 may be gradually narrowed from the upper portion to the lower portion so that the striker 10 can be guided to the engagement position located approximately at the center of the housing 110.

The first support shaft 121 and the second support shaft 122 are installed on both sides of the entrance guide recesses 113 and 114 of the housing 110 in parallel to each other. Both ends of the first support shaft 121 and the second support shaft 122 are supported by the front portion 111 and the rear portion 112 of the housing 110, respectively. The third support shaft 123 is installed below the middle portion of the housing 110 between the first support shaft 121 and the second support shaft 122 while being in parallel with the first support shaft 121 and the second support shaft 122. As shown in FIG. 1, one end of the third support shaft 123 is fixed to the front portion 111 of the housing 110 and extends a predetermined length backward in the housing 110.

Figure 7:
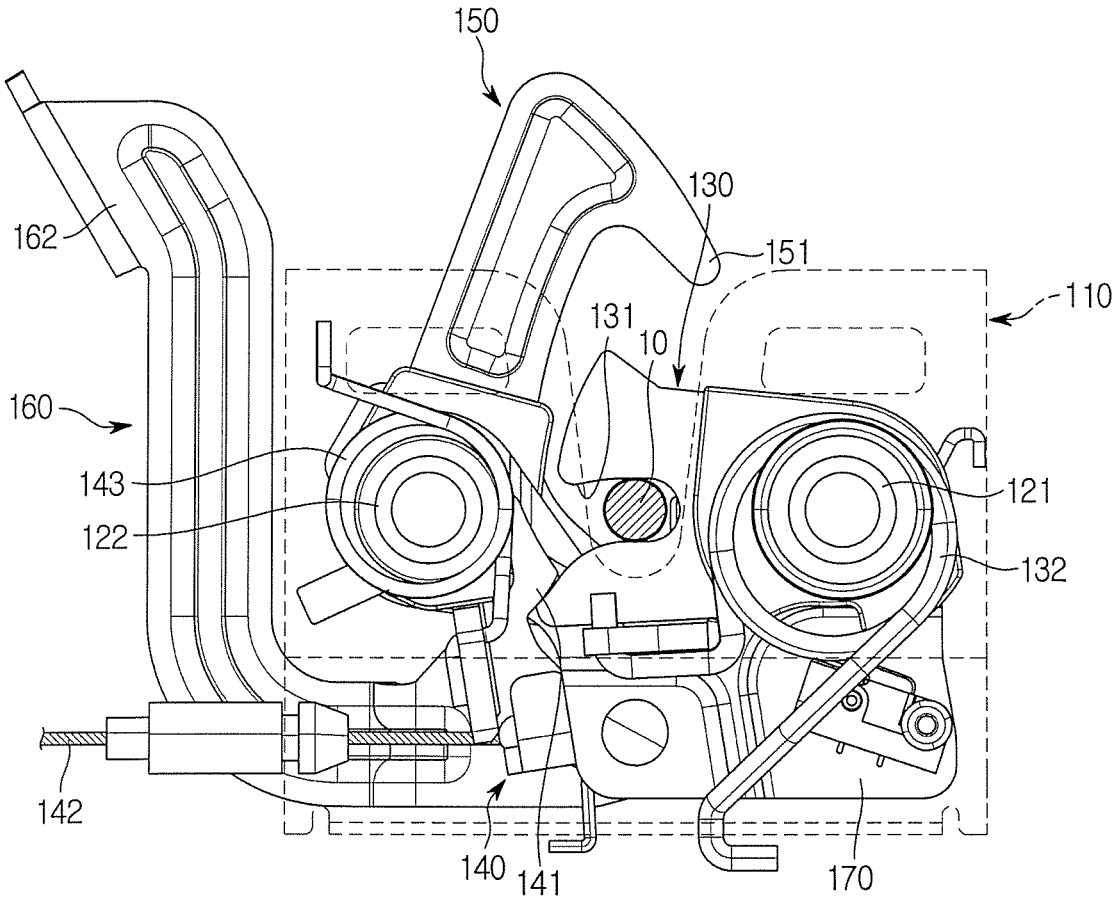
FIG. 7 is a rear view of the state of FIG. 6.

One end of the claw 130 is rotatably installed on the first support shaft 121 inside the housing 110. The claw 130 is provided with a restraint groove 131 at a free end side so that the claw 130 can restrain or release the striker 10 entering the inside of the housing 110. As shown in FIGS. 4 and 7, a first torsion spring 132 is installed on the first support shaft 121 to apply a rotational force so as to rotate the claw 130 in a direction of releasing the restraint of the striker 10.

As shown in FIGS. 4 and 7, one end of the pawl 140 is rotatably installed on the second support shaft 122 inside the housing 110. The pawl 140 extends downward from the second support shaft 122, and a hood opening cable 142 is connected to a lower end of the pawl 140. The hood opening cable 142 may be connected to a hood opening lever (not shown) provided on the driver's seat side of the vehicle. The pawl 140 restrains the claw 130 by catching a free end of the claw 130 with a jaw 141 of the pawl 140 in a state in which the claw 130 locks the striker 10. Accordingly, the pawl 140 may maintain the restraint of the striker 10 by the claw 130 or release the restraint of the striker 10 by releasing the restraint of the claw 130 through the rotation. A second torsion spring 143 is installed on the second support shaft 122 to rotate the pawl 140 in a direction of restraining the claw 130.

Figure 6:
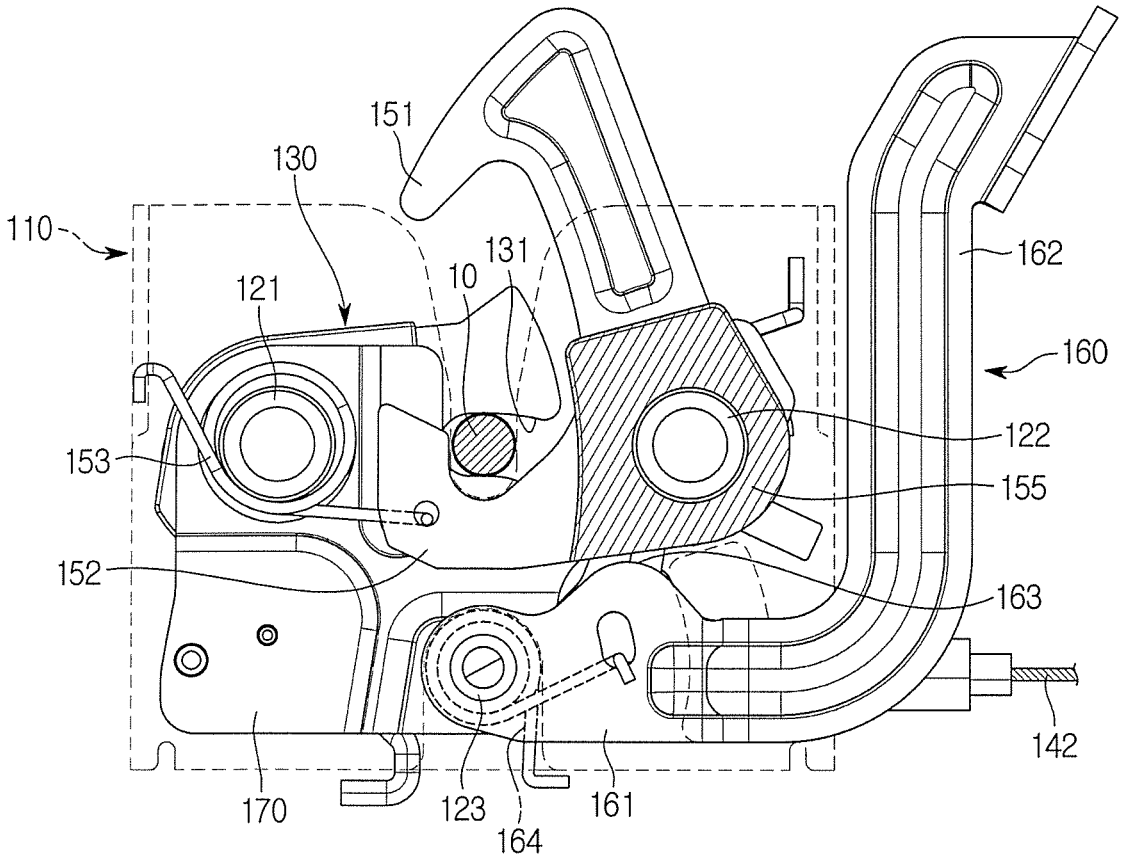
FIG. 6 is a front view of the internal components of a hood latch apparatus for a vehicle according to an embodiment of the present disclosure, illustrating a state in which a claw restrains a striker.

As shown in FIGS. 3 and 6, the safety hook 150 is rotatably installed on the second support shaft 122 inside the housing 110. The safety hook 150 includes a latching portion 151 at an upper side thereof to restrict the opening of the hood by catching the striker 10 that is lifted after the restraint by the claw 130 is released. The latching portion 151 may be exposed at an upper portion of the housing 110. As shown in FIG. 6, a third torsion spring 153 is installed on the first support shaft 121 to rotate the safety hook 150 in a direction of locking the striker 10. The safety hook 150 includes a spring connection portion 152 extending from the portion coupled to the second support shaft 122 to the first support shaft 121 in order to install the third torsion spring 153.

Figure 9:
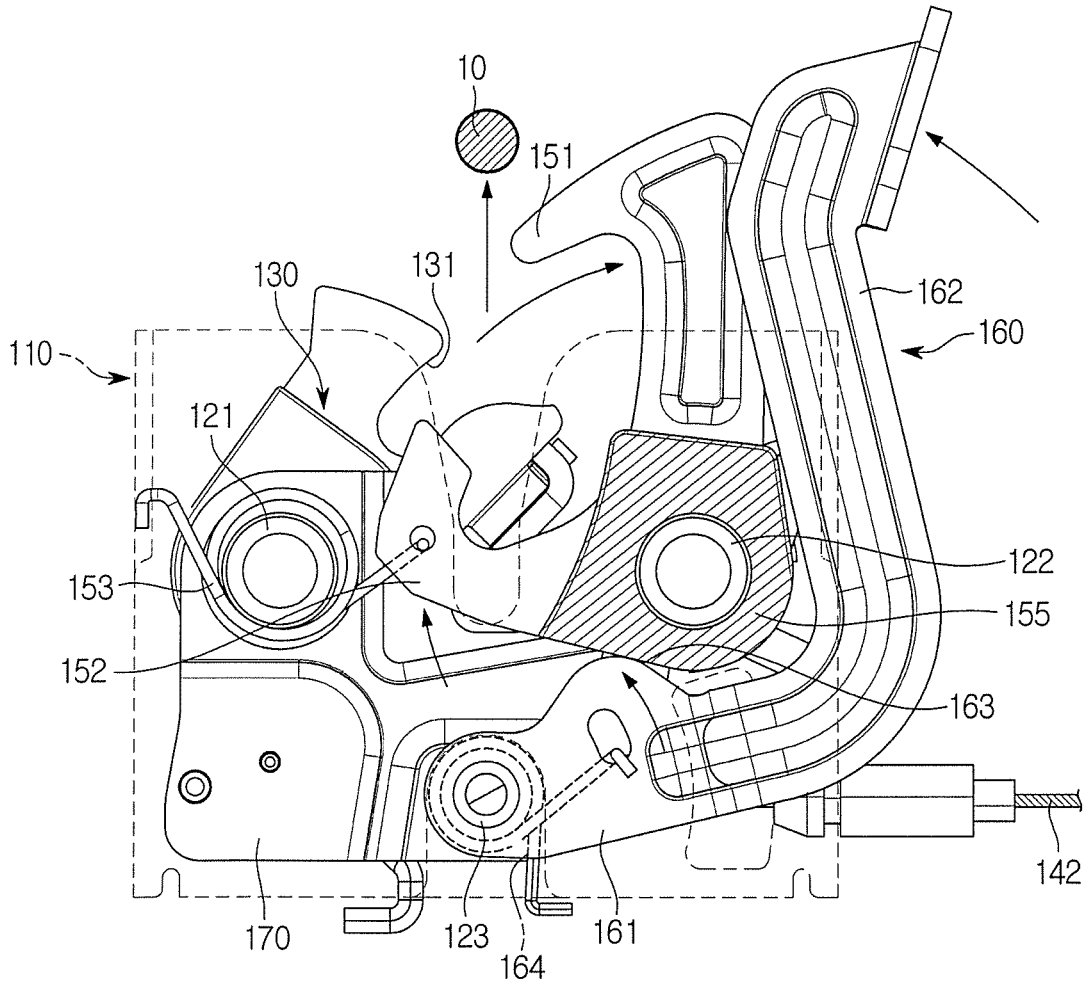
FIG. 9 is a front view of the internal components of a hood latch apparatus for a vehicle according to an embodiment of the present disclosure, illustrating a state in which the safety hook is rotated by the manipulation of a safety lever to release the striker from the locking.

As shown in FIGS. 1, 3, and 9, one side of the safety lever 160 is rotatably supported on the third support shaft 123 inside the housing 110. The safety lever 160 includes a user manipulation portion 162 extending from the inside of the housing 110 to the outside of the housing 110 so as to be manipulated by a user, and a pressing portion 163 for pressing a lower portion of the safety hook 150 upward to rotate the safety hook 150 in a direction of unlocking the striker 10 when the user manipulates and rotates the user manipulation portion 162. The safety lever 160 further includes a lateral extension portion 161 extending from the portion coupled to the third support shaft 123 in the housing 110 toward a lateral direction of the housing 110 by a predetermined length, and the pressing portion 163 may be formed to protrude upward on the upper side of the lateral extension portion 161 so as to press the lower end of the safety hook 150 at the lower portion of the safety hook 150 to rotate the safety hook 150.

As shown in FIGS. 1 and 3, the user manipulation portion 162 of the safety lever 160 may extend from the lateral extension portion 161 to the outside of a side of the housing 110 by passing through the front portion 111 of the housing 110. As shown in FIG. 6, a fourth torsion spring 164 is installed on the third support shaft 123 to apply a rotational force to the safety lever 160 so that the safety lever 160 is normally maintained in a state of being rotated downward.

Referring to FIGS. 3 to 5, in the housing 110, a support plate 170 may be installed to support the first support shaft 121, the second support shaft 122, and the third support shaft 123. The support plate 170 may be installed in the form of dividing the inside of the housing 110 into a space in which the claw 130 and the pawl 140 are installed and a space in which the safety hook 150 and the safety lever 160 are installed.

Referring to FIG. 5, the third support shaft 123 supporting the safety lever 160 may have one end thereof fixed to the front portion 111 of the housing 110 and the other end thereof fixed to the support plate 170 inside the housing 110. The lateral extension portion 161 of the safety lever 160 is positioned at a lower portion of the safety hook 150 in the housing 110 so that the pressing portion 163 pushes up the safety hook 150.

As mentioned above, the hood latch apparatus 100 according to the present embodiment can reduce the volume in the front-rear direction because the safety lever 160 is supported by the third support shaft 123 inside the housing 110 and the lateral extension portion 161 of the safety lever 160 is positioned at a lower portion of the safety hook 150. Further, the hood latch apparatus 100 can provide a beautiful appearance of the front portion 111 as shown in FIG. 1, because the third support shaft 123 does not protrude outside the front portion 111 of the housing 110 and the lateral extension portion 161 of the safety lever 160 is positioned within the housing 110 so as not to be exposed. In addition, the hood latch apparatus 100 can reduce corrosion to enhance the durability because most of components are positioned in the housing 110.

Referring to FIGS. 3 and 6, the safety hook 150 may include a protective cover portion 155 covering both sides of a portion coupled to the second support shaft 122 and a portion in contact with the pressing portion 163 of the safety lever 160. The protective cover portion 155 may be coupled to the safety hook 150 in an integrated manner by injection molding of a resin material in the process of manufacturing the safety hook 150.

The protective cover portion 155 prevents the pressing portion 163 of the safety lever 160 from directly contacting the safety hook 150 so that the noise caused by the friction between the metals can be reduced and the durability can be enhanced by preventing the corrosion of the contact portions. Further, the protective cover portion 155 covers both sides of the safety hook 150 so that the safety hook 150 does not directly contact the front portion 111 of the housing 110 and the support plate 170, thereby reducing a friction noise.

Hereinafter, the operation of the hood latch apparatus 100 will be described with reference to FIGS. 6 to 9.

Figure 8:
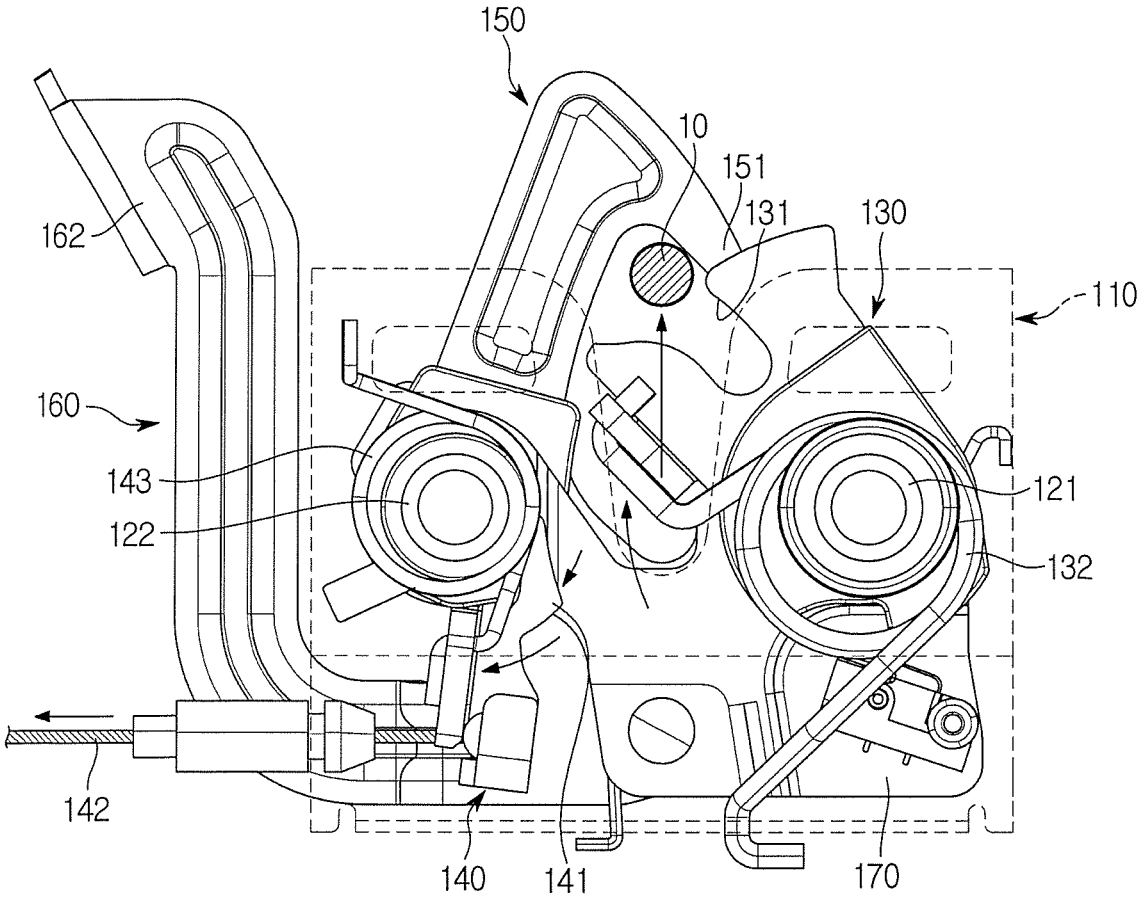
FIG. 8 is a rear view of the internal components of a hood latch apparatus for a vehicle according to an embodiment of the present disclosure, illustrating a state in which the striker that is lifted is caught in a safety hook.

FIG. 6 is a front view of the internal components of the hood latch apparatus, illustrating a state in which the claw restrains the striker, FIG. 7 is a rear view of the state of FIG. 6. FIG. 8 is a rear view of the internal components of the hood latch apparatus, illustrating a state in which the striker that is lifted is caught in the safety hook. FIG. 9 is a front view of the internal components of the hood latch apparatus, illustrating a state in which the safety hook is rotated by the manipulation of the safety lever to release the striker from the locking.

Referring to FIGS. 6 and 7, when the striker 10 enters the restraint position of the hood latch apparatus 100, the claw 130 is rotated so as to catch and restrain the striker 10, and the pawl 140 catches the free end of the claw 130 to maintain the restraint of the striker 10.

In the state of FIG. 7, when a user manipulates the hood opening lever (not shown) to pull the hood opening cable 142, the restraint of the claw 130 is released by the rotation of the pawl 140, and the claw 130 is rotated upward by the rotational force of the first torsion spring 132 to release the restraint of the striker 10, as shown in FIG. 8.

After the restraint by the claw 130 is released, the striker 10 is lifted up and caught by the safety hook 150, whereby the rise of the striker is restricted. The safety hook 150 prevents the hood from being opened by restricting the rising by hooking the striker 10 even if the claw 130 releases the restraint of the striker 10.

In the state of FIG. 8, when the user manipulates the safety lever 160, the pressing portion 163 of the safety lever 160 pushes the lower end of the safety hook 150 up, as shown in FIG. 9. Accordingly, the safety hook 150 is rotated in a direction of releasing the restraint of the striker 10 and finally the restraint of the hood can be released.

As is apparent from the above, the hood latch apparatus for a vehicle according to an embodiment of the present disclosure can reduce the volume in a front-rear direction because the safety lever is supported by the third support shaft inside the housing, and a portion of the safety lever is positioned at a lower portion of the safety hook.

Further, the hood latch apparatus for a vehicle according to an embodiment of the present disclosure can provide a beautiful front appearance because the third support shaft does not protrude outside the front portion of the housing and the lateral extension portion of the safety lever is positioned in the housing so as not to be exposed.

In addition, the hood latch apparatus for a vehicle according to an embodiment of the present disclosure can reduce corrosion to enhance the durability because most of components are positioned in the housing.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A hood latch apparatus for a vehicle comprising:

a housing having entrance guide recesses at a front portion and a rear portion of the housing, respectively, to allow a striker to enter;

a first support shaft and a second support shaft disposed at both sides of the entrance guide recesses, respectively, while both ends of each of the first support shaft and the second support shaft are supported at the front portion and the rear portion of the housing;

a claw rotatably connected to the first support shaft in the housing and configured to catch and restrain the striker entering an inside of the housing or release the restraint of the striker;

a pawl rotatably connected to the second support shaft in the housing and configured to restrain the claw or release the restraint of the claw;

a safety hook rotatably connected to the second support shaft in the housing and configured to restrict opening of a hood by catching the striker that is lifted after the restraint by the claw is released; and a safety lever having one end thereof rotatably supported on a third support shaft, which is disposed inside the housing, the safety lever including:

a user manipulation portion extending to an outside of the housing; and a pressing portion for pressing a lower portion of the safety hook to rotate the safety hook in a restraint releasing direction during a rotation operation.

2. The hood latch apparatus according to claim 1, wherein the third support shaft is disposed on a lower side at an intermediate portion between the first support shaft and the second support shaft, wherein the safety lever comprises a lateral extension portion extending in a lateral direction of the housing from the third support shaft in the housing, and wherein the pressing portion is disposed at an upper side of the lateral extension portion and presses and rotates a lower end of the safety hook.

3. The hood latch apparatus according to claim 2, wherein the user manipulation portion of the safety lever extends from the lateral extension portion to the outside of the housing laterally by passing through the front portion of the housing.

4. The hood latch apparatus according to claim 1, wherein the safety hook comprises a protective cover portion covering both sides of a first portion, which is coupled to the second support shaft, and a second portion, which is in contact with the pressing portion.

5. The hood latch apparatus according to claim 4, wherein the protective cover portion is integrally coupled to the safety hook.

6. The hood latch apparatus according to claim 1, further comprising a support plate disposed inside the housing to divide the inside of the housing into a first space in which the claw and the pawl are installed and a second space in which the safety hook and the safety lever are installed, the support plate supporting the first support shaft, the second support shaft, and the third support shaft.

* * * * *